US006240858B1

(12) United States Patent
Mandall

(10) Patent No.: US 6,240,858 B1
(45) Date of Patent: Jun. 5, 2001

(54) PENETRATION RESISTANT PANEL

(76) Inventor: Michael C. Mandall, 5442 E. Cambridge Ave., Phoenix, AZ (US) 85018

( * ) Notice: Subject to any disclaimer, the term of this patent is extended or adjusted under 35 U.S.C. 154(b) by 0 days.

(21) Appl. No.: 09/302,819

(22) Filed: Apr. 30, 1999

Related U.S. Application Data

(63) Continuation-in-part of application No. 08/863,343, filed on May 27, 1997, now abandoned.

(51) Int. Cl.[7] ..... E06B 9/00

(52) U.S. Cl. ..... 109/49.5; 428/911; 102/303; 89/36.02

(58) Field of Search ..... 109/49.5, 76, 80–85; 102/303; 89/36.02, 36.04; 428/911

(56) References Cited

U.S. PATENT DOCUMENTS

| | | | | |
|---|---|---|---|---|
| 63,046 | * | 3/1867 | Hendrickson . | |
| 100,741 | * | 3/1870 | Ewing | 109/81 |
| 1,236,033 | * | 8/1917 | Almengual | 109/82 X |
| 1,354,671 | * | 10/1920 | Magnuson | 109/81 X |
| 1,625,061 | * | 4/1927 | Trout | 109/85 X |
| 2,077,729 | * | 4/1937 | Wilcox | 109/80 X |
| 2,110,322 | * | 3/1938 | Calzavara | 109/81 |
| 2,326,713 | * | 8/1943 | Wesseler | 109/49.5 X |
| 2,773,459 | * | 12/1956 | Sechy | 109/82 |
| 3,519,529 | * | 7/1970 | Cook | 109/80 X |
| 3,895,162 | * | 7/1975 | Lemont et al. | 109/83 X |
| 3,969,563 | * | 7/1976 | Hollis, Sr. | 428/175 |
| 4,090,005 | * | 5/1978 | Morgan | 428/911 X |
| 4,179,979 | * | 12/1979 | Cook et al. | 109/49.5 X |
| 4,186,648 | * | 2/1980 | Clausen et al. | 109/49.5 X |
| 4,727,789 | * | 3/1988 | Katsanis | 109/49.5 X |
| 4,732,803 | * | 3/1988 | Smith, Jr. | 109/49.5 X |
| 5,149,910 | * | 9/1992 | McKee | 109/82 X |
| 5,200,256 | * | 4/1993 | Dunbar | 109/49.5 X |
| 5,272,954 | * | 12/1993 | Crouch | 109/49.5 X |
| 5,329,864 | * | 7/1994 | Doring | 109/49.5 |
| 5,531,500 | * | 7/1996 | Podvin | 109/49.5 |
| 5,563,364 | * | 10/1996 | Alhamad | 109/49.5 X |
| 5,591,933 | * | 1/1997 | Li et al. | 89/36.02 |
| 5,654,518 | * | 8/1997 | Dobbs | 109/49.5 X |
| 5,740,635 | * | 4/1998 | Gil et al. | 109/82 X |
| 5,851,932 | * | 12/1998 | Dickson et al. | 428/911 X |
| 5,853,863 | * | 12/1998 | Kim | 428/911 X |

FOREIGN PATENT DOCUMENTS

| | | | | |
|---|---|---|---|---|
| 701489 | * | 12/1940 | (DE) | 109/49.5 |
| 2365680 | * | 4/1978 | (FR) | 109/83 |

* cited by examiner

*Primary Examiner*—Suzanne Dino Barrett
(74) *Attorney, Agent, or Firm*—Cahill, Sutton & Thomas P.L.C.

(57) ABSTRACT

A panel includes a plurality of elongated members in a serpentine configuration under axial compression. The members are adapted to straighten to extend into an opening cut through the panel and the members.

16 Claims, 5 Drawing Sheets

PENETRATION RESISTANT PANEL

This application is a continuation-in-part of application Ser. No. 08/863,343 filed filed May 27, 1997 now abandoned.

TECHNICAL FIELD

This invention is concerned with preventing unauthorized entry into secure areas.

BACKGROUND ART

Inventors have long been concerned with devising penetration resistant panels to serve as doors for safes and vaults.

U.S. Pat. No. 63,046 granted Mar. 19, 1867 to E. M. Hendrickson for "Burglar-Proof-Safe" discloses a safe wall containing soft metal wire bent in spiral form and intended to break a drill penetrating the panel.

J. M. Ewing in his U.S. Pat. No. 100,741 granted Mar. 15, 1870 for "Burglar Proof Safe" disclosed a panel composed of chains interlinked or interwoven with each other. In theory the burglar's tools were turned aside by the yielding chain links.

U.S. Pat. No. 2,773,459 granted Dec. 11, 1956 to P. S. Sechy for "Protective Wall for Use Against Radiation and Explosive Forces" discloses a wall structure composed of a plurality of corrugated metal sheets, resilient material and concrete.

R. E. Hollis, Sr. disclosed the use of overlapping, spot welded wavy steel wires in his U.S. Pat. No. 3,969,563 granted Jul. 13, 1976 for "Protection Wall Structure".

The fact is any of these wall structures can be penetrated by the tools and explosives available to the modern burglar or espionage agent if the perpetrators are given sufficient time.

SUMMARY OF THE INVENTION

The objective of this invention is to significantly increase the time required for the culprit to enter the secured area. With a long enough delay security personnel have time to react and thwart the break-in.

This invention provides a plurality of elongated resilient members under axial compression in serpentine configurations. When an opening is cut or blasted in the panel any members which are cut straighten from the energy stored therein to thrust their cut ends into the opening. The culprit is then faced with the further task of clearing the opening by cutting or blasting away the protruding ends of the members before gaining entry. The elongated members may be braided wire cables, leaf springs or helical springs.

BRIEF DESCRIPTION OF THE DRAWINGS

The invention is described in greater detail hereinafter by reference to the accompanying drawings wherein.

BEST MODES FOR CARRYING OUT THE INVENTION

Figure 1:
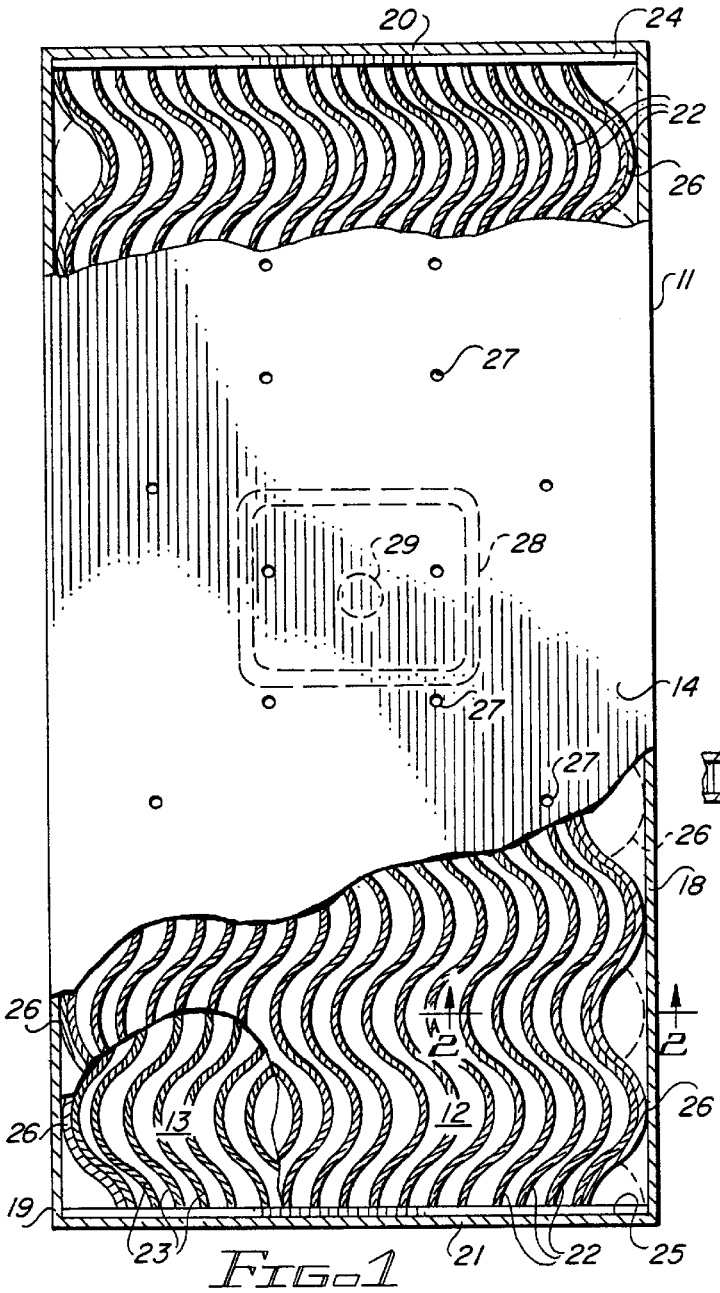
FIG. 1 is an elevational view of a door-like panel embodying the invention—portions of the panel have been broken away to reveal the interior of the panel.

In the drawings the numeral 11 designates generally a door constructed in accordance with this invention. The door 11 comprises two similarly constructed panels 12 and 13 placed in face-to-face relationship. We will refer to panel 12 as the "front" panel and to panel 13 as the "back" panel.

Front panel 12 has a rectangular sheet metal face plate 14 and a sheet metal back plate 15. Similarly, back panel 13 has a face plate 16 and a back plate 17. Panels 12 and 13 are held together by side plates 18 and 19 and a top plate 20 and a bottom plate 21 which are preferably welded to the panels as the final step of fabrication of the door 11.

Figure 2:
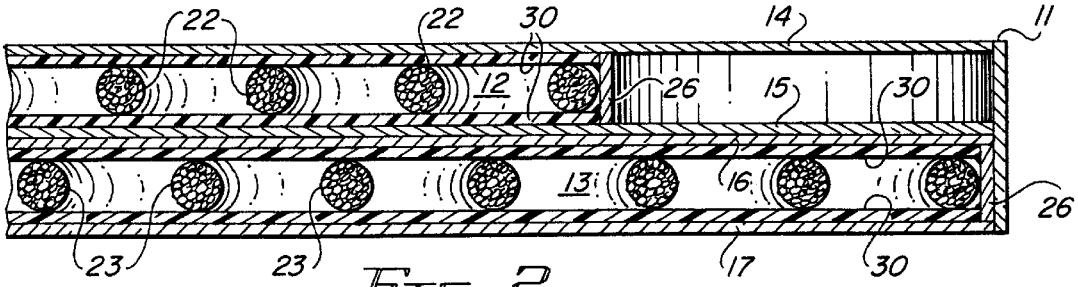
FIG. 2 is an enlarged sectional view taken as indicated by line 2—2 in FIG. 1.

In the door illustrated in FIG. 2 the back plate 15 of panel 12 is in face-to-face contact with face plate 16 of panel 13. In some applications, however, it may be desirable to provide space between panels 12 and 13. The space between the panels may be empty or contain a blast resistant material. And for some applications it may be desirable to perforate one or more of plates 14, 15, 16 and 17.

A unique feature of the door 11 is presence in each of panels 12 and 13 of a plurality of serpentine, or sinuous, elongated resilient members. In this embodiment of the invention the members are braided wire cables. The cables in front panel 12 are identified by reference numeral 22, while the cables in rear panel 13 are identified by reference numeral 23. Both sets of cables 22 and 23 are under compression, being welded or otherwise affixed at their ends to upper and lower end pieces designated 24 and 25 for each of panels 12 and 13.

The two sets of cables 22 and 23 are identical, except that the undulations in cables 22 are out of phase by 180° with cables 23. As best shown in FIG. 1, a rightward undulation in cables 22 overlies a leftward undulation in cables 23 and vice versa. For some applications it may be desirable to orient cables 22 and 23 at right angles to each other.

Cables 22 and 23 are stabilized in their compressed, serpentine condition by side seal strips 26 on opposite sides of sets of cables 22 and 23 in each panel 12 and 13. Seal strips 26 are bent to match the undulations in the cables 22 and 23 prior to being affixed to the face and back plates of panels 12 and 13.

The cables 22 and 23 are preferably further stabilized in their compressed undulating condition by a plurality of tie pins, or straps, 27 which control outward bulging of the front and back plates of panels 12 and 13. These pins are spaced across the faces of each panel 12 and 13 and extend between and are affixed to the face plate and back plate of each panel. Each tie pin 27 is positioned at the neutral node of adjoining cables so as not to interfere with proper functioning of the cables.

An attempt may be made to penetrate the door 11 by cutting or blowing an opening in the door. Such an attempt could be made using a picture frame, shaped charge of explosive material indicated at 28 in FIG. 1. This charge may be accompanied by a knockout shaped or bulk charge of explosive material as indicated by numeral 29 in FIG. 1. Such charges are capable of blowing a rectangular section through both panels 12 and 13 and the cables in the rectangular section.

Figure 3:
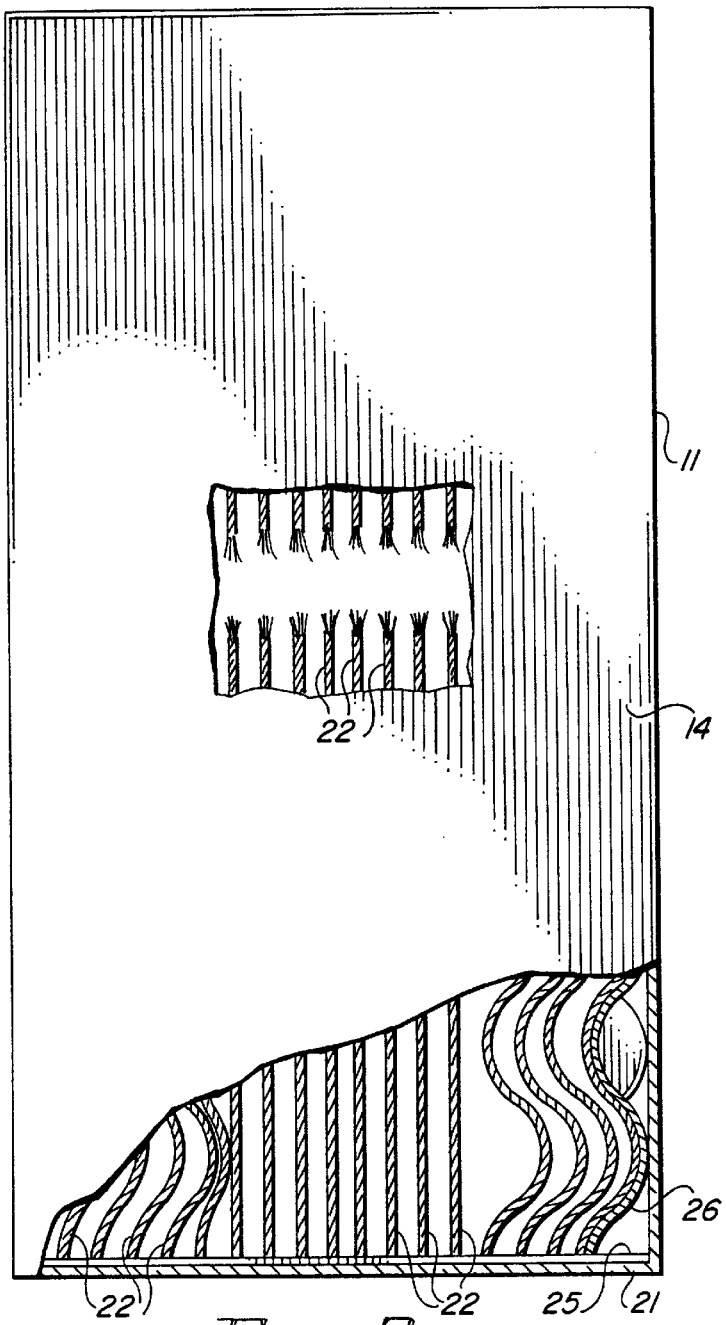
FIG. 3 is a view similar to FIG. 1 illustrating a panel after an opening has been blasted therein.

A result of such a breach attempt is illustrated in FIG. 3. An opening in the plates of both panels 12 and 15 has been blown away and the cables 22 and 23 in the opening are cut. The resulting removal of compression on the undulating cables 22 and 23 allows the cables to straighten and thrust the cut ends of the cables into the opening thereby restricting passage through the opening.

Figure 4:
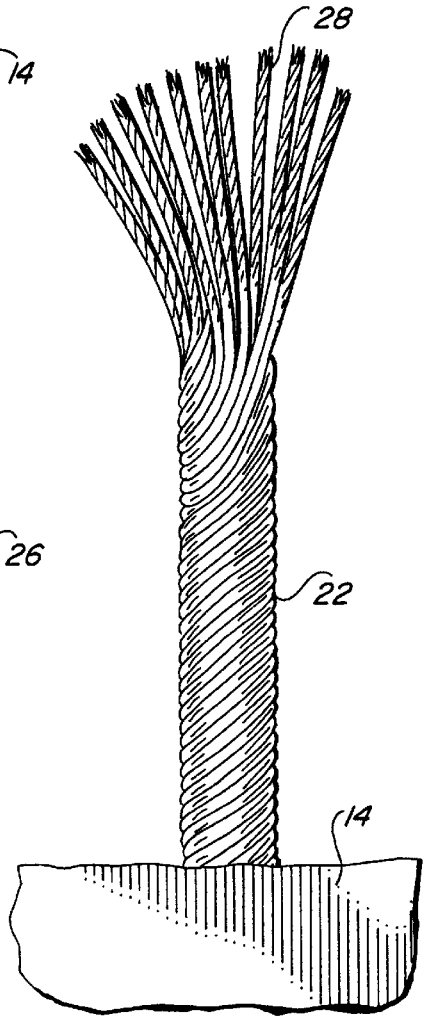
FIG. 4 is an enlarged view of the cut end of one of the cables employed in the panel.

The culprit then must take the additional time to prepare and set off another charge to remove the restricting cables or proceed to cut off the restricting cables in the opening. And the cut ends of the cables have a tendency to fray as indicated at 28 in FIG. 4. This presents a very messy work environment for the culprit.

To facilitate the straightening and extension of cut cables 22 and 23 an unctuous material may be provided between cables 22 and plates 14 and 15 and between cables 23 and plates 16 and 17. Suitable materials for this purpose may be sheets 30 of polypropylene plastic, glass or other lubricated surface material.

Figure 5:
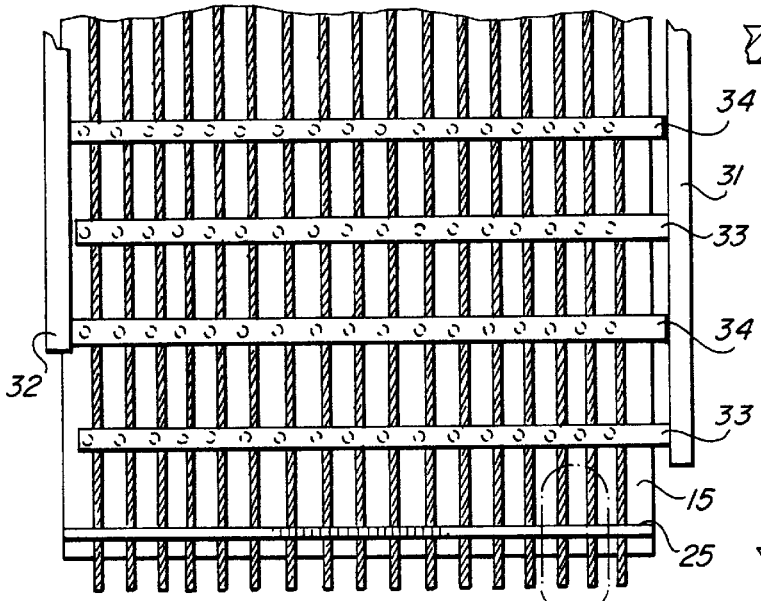
FIG. 5 is a somewhat diagrammatic plan view of apparatus for imparting the undulating configuration to elongated members employed in panel.
Figure 6A:
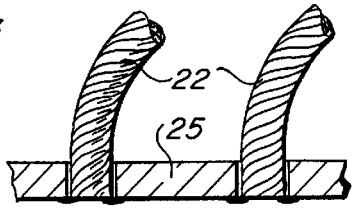
FIG. 6A is an enlarged view of that portion of FIG. 6 within oval 6A.
Figure 7:
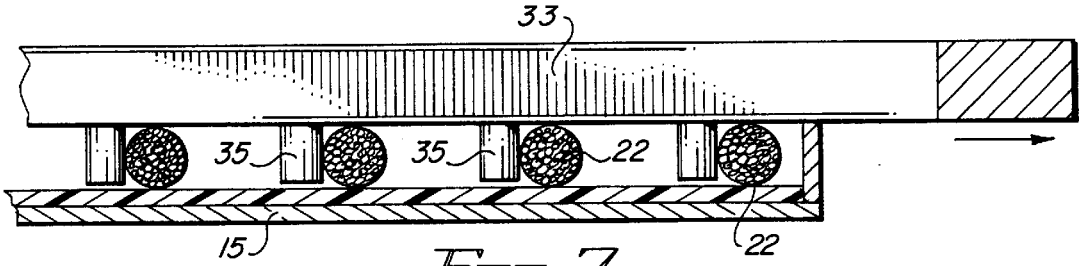
FIG. 7 is a sectional view taken generally as indicated by line 7—7 in FIG. 5.
Figure 6:
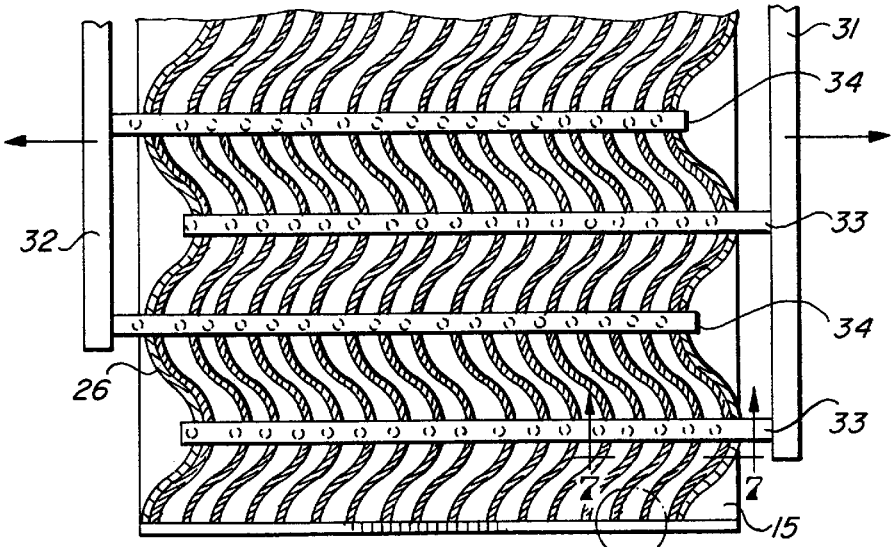
FIG. 6 is a view similar to FIG. 5, but showing the elongated members pulled into the undulating configuration.

FIGS. 5 through 7 illustrate, somewhat diagrammatically a method for imparting the undulating configuration to cables such as cables 22 in panel 12.

The cables 22 are laid out in parallel fashion on panel rear plate 15 with the ends of the cables through the holes in upper and lower end pieces (only the lower end piece 25 is shown in FIGS. 5 and 6). Overlying the cables 22 are a pair of retractor structures 31 and 32 as shown in FIG. 5. Retractor structures 31 and 32 have arms 33 and 34, respectively, extending in opposite directions and interdigitating. Each retractor arm 34 and 25 has a plurality of downwardly directed pins 35 for engaging the cables 22.

Figure 5A:
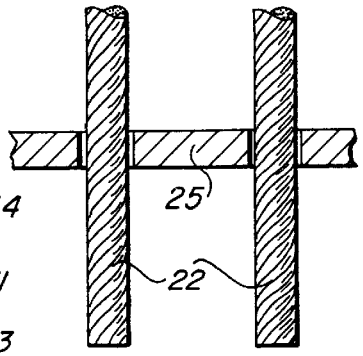
FIG. 5A is an enlarged view of the portion of FIG. 5 within oval 5A.

When retractor structures 31 and 32 are pulled apart or one is held and the other pulled away the pins 35 on their respective arms 33 and 34 pull the cables 22 into the undulating configuration as shown in FIG. 6. This foreshortens the cables drawing their ends inwardly as shown in FIGS. 5A and 6A. The ends of the cables are then welded or otherwise affixed to the top and bottom plates (only the bottom plate 25 is shown in FIGS. 5A and 6A). Thereafter the cables are stabilized by the addition of the side strips 26 and the face plate 14.

Removal of the retractor structures 31 and 32 frees the cables 22 to attempt to straighten out. But, inasmuch as the ends of the cables are affixed to the upper and lower end pieces 24 and 25 compressive forces are developed in the cables.

Figure 8:
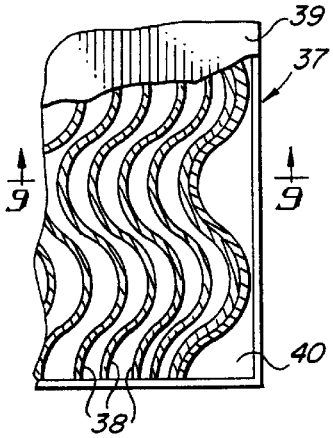
FIG. 8 is a fragmentary view of the interior of a panel illustrating a different mode for carrying out the invention.
Figure 9:
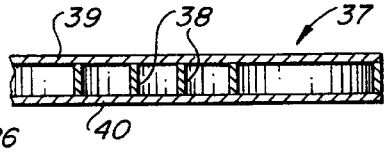
FIG. 9 is a sectional view taken as indicated by line 9—9 in FIG. 8.

FIGS. 8 and 9 illustrate another construction for the penetration resistant panel of this invention. This panel 37 has therein a plurality of undulating strips 38 of metallic spring material sandwiched between a face plate 39 and a back plate 40. The strips 38 are under compression and function in the same manner as the cables described above in the event someone attempts to breach the panel.

Figure 10:
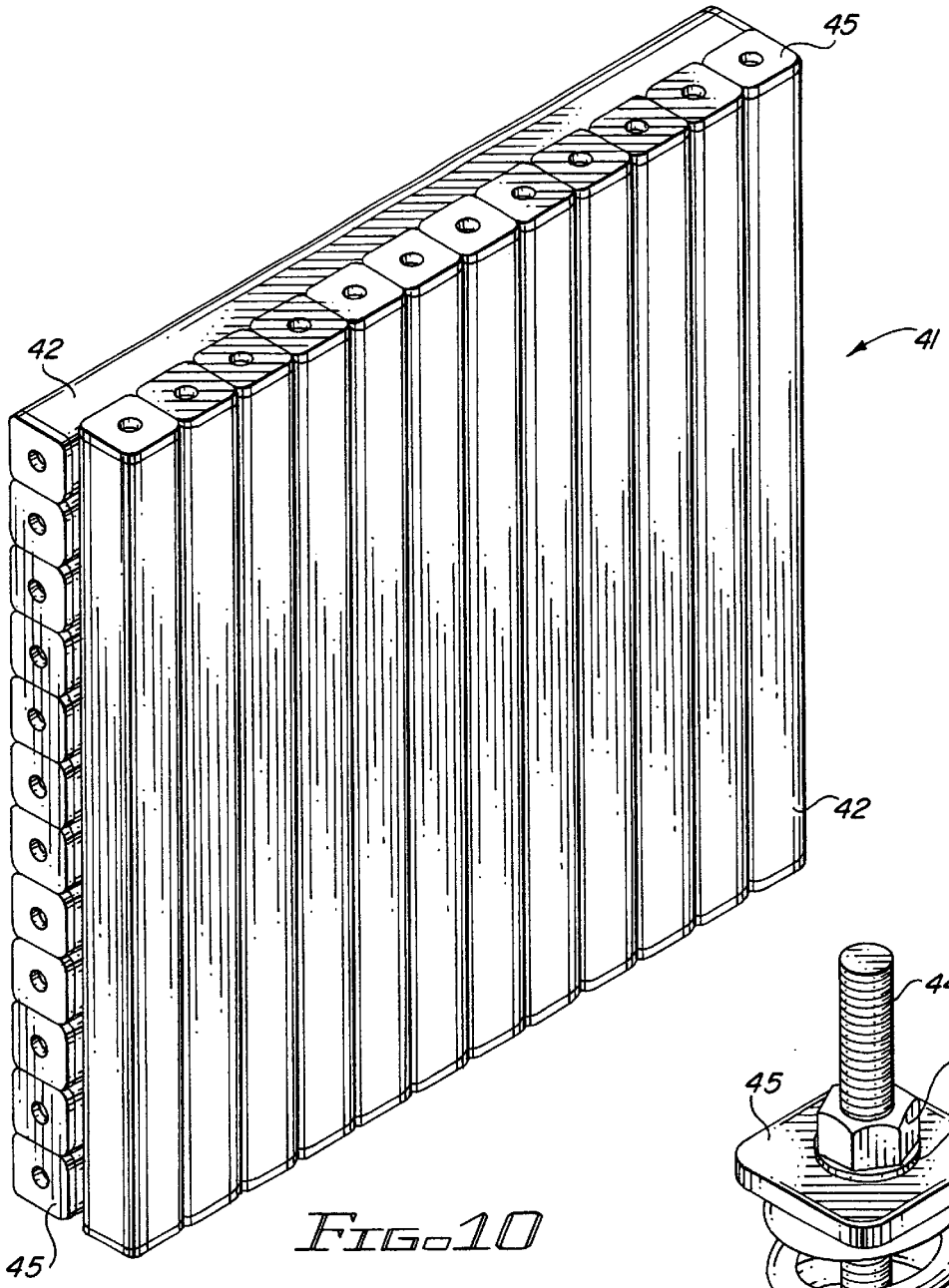
FIG. 10 illustrates yet a further mode for carrying out the invention in which the panel is made up of metal tubes containing helical springs.
Figure 11:
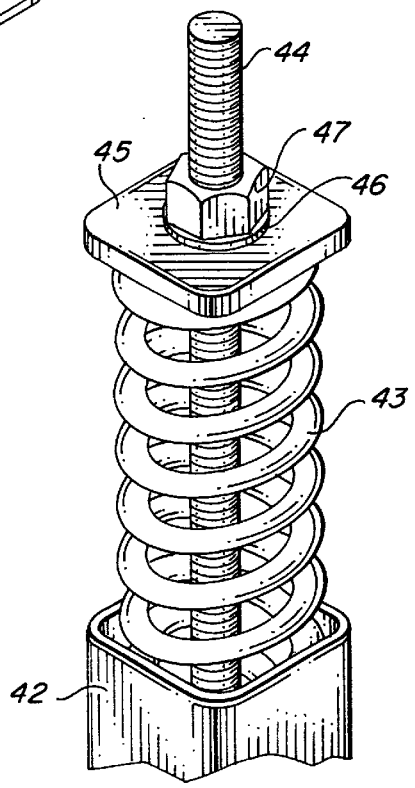
FIG. 11 illustrates a method of assembling a spring into a tube.

FIGS. 10 and 11 illustrate yet another construction for the penetration resistant panel of this invention. Here, the panel is designated generally by reference numeral 41 and comprises two layers of metal tubes 42. It is preferred that the two layers of tubes 42 be oriented at a right angle to each other.

Each tube 42 contains a compressed metal helical spring 43.

Assembling the spring 43 in the tube 42 is illustrated in FIG. 11. An uncompressed spring 43 is inserted in a tube 42. A threaded rod 44 is inserted down through the core of the spring and affixed to an end plate 45 secured to the bottom of the tube. Another end plate is placed over the rod 44 to rest atop the uncompressed spring 43. A washer 46 is placed atop the end plate and a hex nut 47 is threaded into the rod 44. Hex nut 47 is turned with a wrench (not shown) to press the end plate 45 down against the spring 43. When the end plate 45 comes into contact with the upper end of tube 42 the two are joined, as by welding, to hold the spring in a compressed condition within the tube. Rod 44 is then removed.

If the panel 41 is breached some of the springs are cut and they expand to at least partially close the breach opening. As in the manner of the previously described panels the perpetrator is required to spend additional time removing the exposed ends of the springs 43.

FIGS. 12 through 15 illustrate further means for stabilizing the compressed, serpentine members inside the panels.

Figure 12:
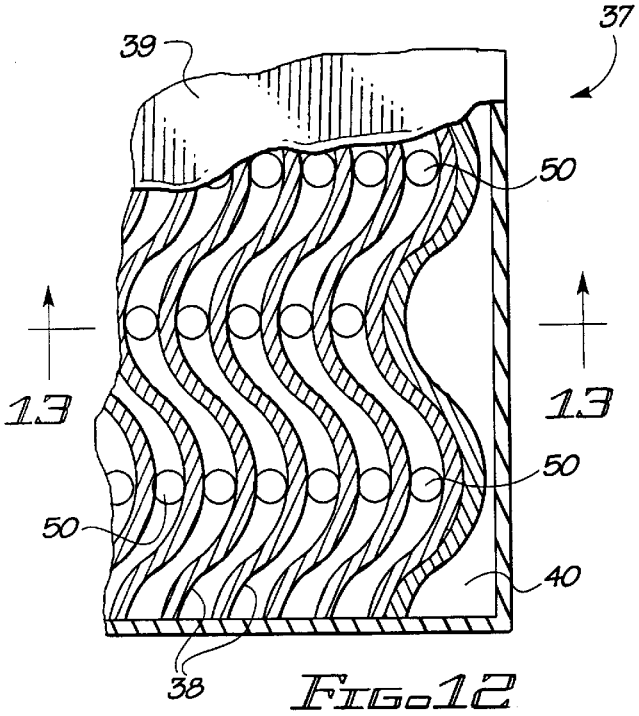
FIG. 12 is a fragmentary view of the interior of a panel employing stabilizing spacers between the undulating members.
Figure 13:
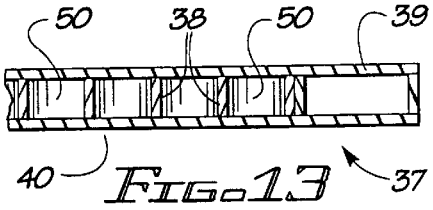
FIG. 13 is a sectional view taken as indicated by line 13—13 in FIG. 12.

The panel of FIGS. 12 and 13, is like panel 37 illustrated in FIGS. 8 and 9. This panel has therein a plurality of undulating strips 38 of metallic spring material sandwiched between a face plate 39 and a back plate 40. Positioned between adjacent strips 38 of the array of strips are a plurality of stabilizing means in the form of stabilizing bodies 50. The bodies 50 are located at the apexes of the undulations in the several strips 38.

The stabilizing bodies 50 may simply be wedged into place between adjoining strips 38 or may or may not be affixed to one but not both of the neighboring strips 38. The stabilizing bodies 50 thus do not interfere with relaxation and extension of cut strips 38 into an opening cut in the panel. And stabilizing bodies 50 may be made from a variety of materials ranging from metal to wood. Although the axial compressive forces contained within the undulating strips 38 are high, the transverse forces acting between and tending to move the strips 38 are very light, so the stabilizing bodies need not possess a great deal of strength.

Figure 14:
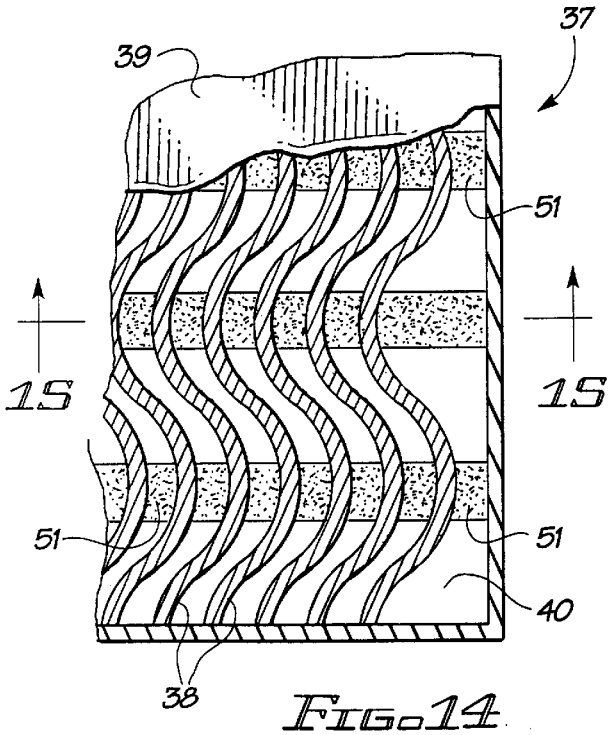
FIG. 14 is a fragmentary view of the interior of a panel employing stabilizing material between the undulating members.
Figure 15:
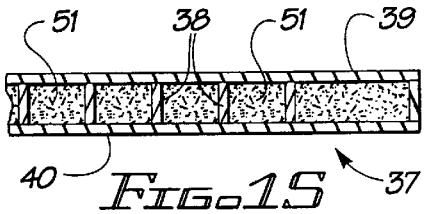
FIG. 15 is a sectional view taken as indicated by line 15—15 in FIG. 14.

Indeed, this low strength requirement is demonstrated by the panel 37 illustrated in FIGS. 14 and 15. Here a slurry of gypsum 51 is poured into the interstices of the array at the apexes of the undulating strips 38. When dried and hardened, although the gypsum has little strength, it is capable of stabilizing the array of strips 38. Moreover, because the gypsum body 51 is quite weak in shear, it is frangible and when the panel is penetrated, severing some of the undulating strips 38, the gypsum offers virtually no resistance to expansion of the cut strips into the opening in the panel.

The term "serpentine" as used in the appended claims is intended as a generic designation for the undulations of cables 22 and 23 and spring strips 38 as well as the helical configuration of springs 43.

What is claimed is:

1. A penetration resistant panel having elongated serpentine resilient members in axial compression therein and capable of relaxing to extend into an opening cut through the panel.

2. The panel of claim 1 wherein said members are braided cables.

3. The panel of claim 1 wherein said members are spring strips.

4. The panel of claim 1 wherein said members are helical springs.

5. A pair of penetration resistant panels as defined in claim 1 wherein the members of one panel extend in a direction which is at approximately right angles to the direction in which the members in the other panel extend.

6. A penetration-resistant panel comprising front and back plates and a plurality of elongated resilient members sandwiched between said plates, said members being under axial compression and possessing serpentine configurations whereby said members are capable of relaxing to extend into an opening cut through the panels.

7. The panel of claim 6 wherein said members are cables.

8. The panel of claim 6 wherein said members are leaf springs.

9. A pair of panels constructed as defined in claim 6, with the serpentine undulations of the members in one panel being out of phase with respect to the serpentine undulations of the members in the other panel.

10. The panels of claim 9 wherein said members are cable.

11. The panels of claim 9 wherein said members are leaf springs.

12. The panel of claim 6 further comprising a layer of unctuous material between each of said plates and said members.

13. The penetration-resistant panel of claim 12 wherein said members are cables.

14. The panel of claim 1 further comprising means for stabilizing adjoining members.

15. The panel of claim 14 wherein said stabilizing means are positioned at the apexes of adjoining members.

16. The panel of claim 14 wherein said stabilizing means comprises a frangible material.

* * * * *